United States Patent [19]

Chung

[11] Patent Number: 4,993,856

[45] Date of Patent: Feb. 19, 1991

[54] PAPER CUTTING DEVICE FOR A PRINTER

[76] Inventor: Wei-Te Chung, 1212 W. McKinley Ave., #9, Sunnyvale, Calif. 94086

[21] Appl. No.: 430,003

[22] Filed: Nov. 1, 1989

[51] Int. Cl.[5] ..... B41J 11/68

[52] U.S. Cl. ..... 400/621.1

[58] Field of Search ..... 400/616, 616.2, 621, 400/621.1; 83/407

[56] References Cited

U.S. PATENT DOCUMENTS 4,211,498 7/1980 Shmizu et al. ..... 400/621

4,579,466 4/1986 Sato et al. ..... 400/120

FOREIGN PATENT DOCUMENTS 2601291 1/1988 France ..... 400/621.1

0297163 12/1986 Japan ..... 400/621.1

*Primary Examiner*—Clifford D. Crowder

*Assistant Examiner*—John S. Hilten

[57] ABSTRACT

A paper cutting device for a printer includes a slot formed in the paper running surface of the printer in alignment with the weakened line of the paper feed strip of the computer form paper to be printed, and a cutting blade mounted on the paper feed cover of the printer and extending into the slot of the paper running surface. When a computer form paper is carried by the circulating belts of the printer to pass over the paper running surfaces, the cutting blades cut the paper feed strips from the remaining portions of the computer form paper.

1 Claim, 3 Drawing Sheets

PAPER CUTTING DEVICE FOR A PRINTER

BACKGROUND OF THE INVENTION

This invention relates to a printer which serves as an output mechanism of a computer, more particularly to a paper cutting device for a printer.

Referring to FIG. 1, a conventional printer has a tractor unit which consists of two paper feed devices (1) disposed on two sides of the printer. As illustrated, each of the paper feed devices (1) includes a base (10) with a paper running surface (11), an endless circulating belt (12), and a pivotally mounted paper feed cover (13). The circulating belt (12) has a plurality of teeth 121 provided on the outer surface thereof which can engage with the paper feed holes in the paper feed strip of the foldable computer form paper to be printed. After a computer form paper is printed and is removed from the printer, it is necessary to separate manually the paper feed strips from the remaining portions of the computer form paper. This removing process is time-consuming.

SUMMARY OF THE INVENTION

It is therefore the main object of this invention to provide a paper cutting device for a printer which is effective for automatic removal of the paper feed strips from a computer form paper.

According to this invention, a paper cutting device for a printer includes a slot formed in the paper running surface of the printer in alignment with the weakened line of the paper feed strip of the computer form paper to be printed, and a cutting blade mounted on the paper feed cover of the printer and extending into the slot of the paper running surface. When a computer form paper is carried by the circulating belts of the printer to pass over the paper running surfaces, the cutting blades cut the paper feed strips from the remaining portions of the computer form paper.

BRIEF DESCRIPTION OF THE DRAWINGS

Other features and advantages of this invention will become apparent in the following detailed description of a preferred embodiment of this invention, with reference to the accompanying drawings in which.

DETAILED DESCRIPTION OF THE PREFERRED EMBODIMENT

Figure 3:
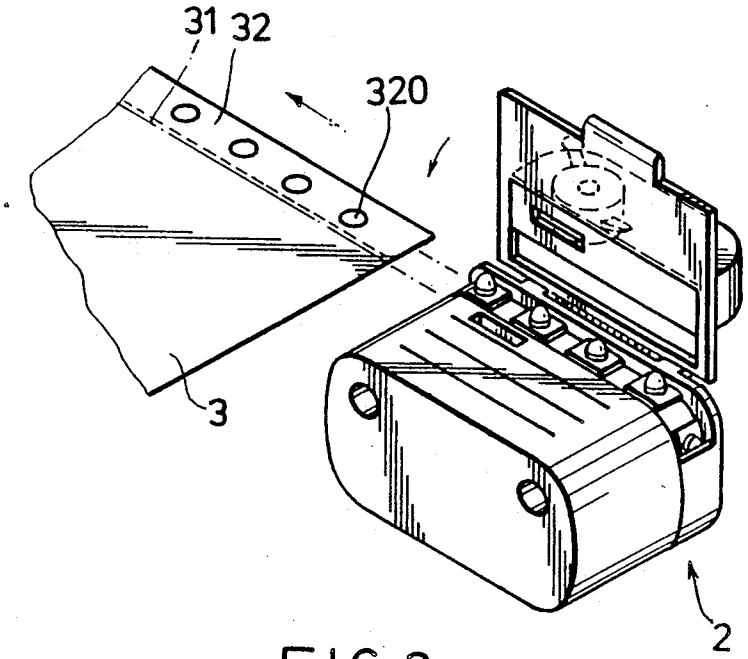
FIG. 3 is a perspective view showing a computer form paper and the paper cutting device of this invention.
Figure 1:
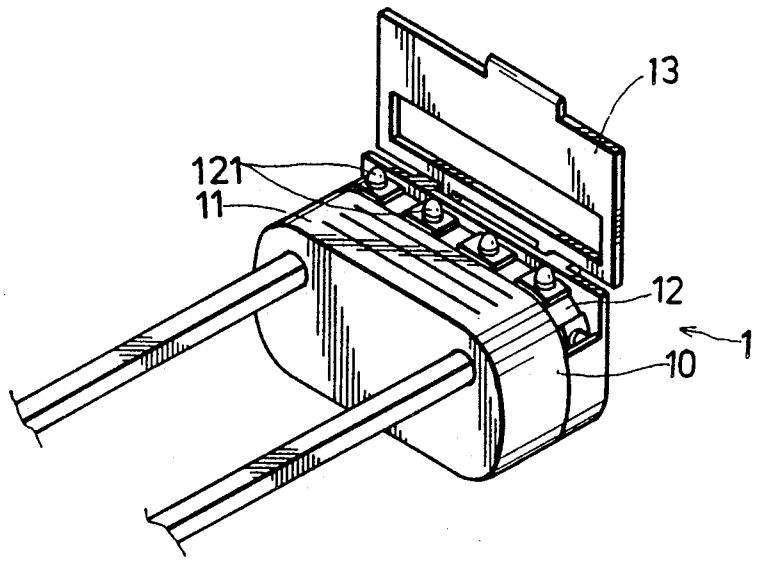
FIG. 1 PRIOR ART
FIG. 1 is a perspective view of a conventional paper feed device for a printer.
Figure 2:
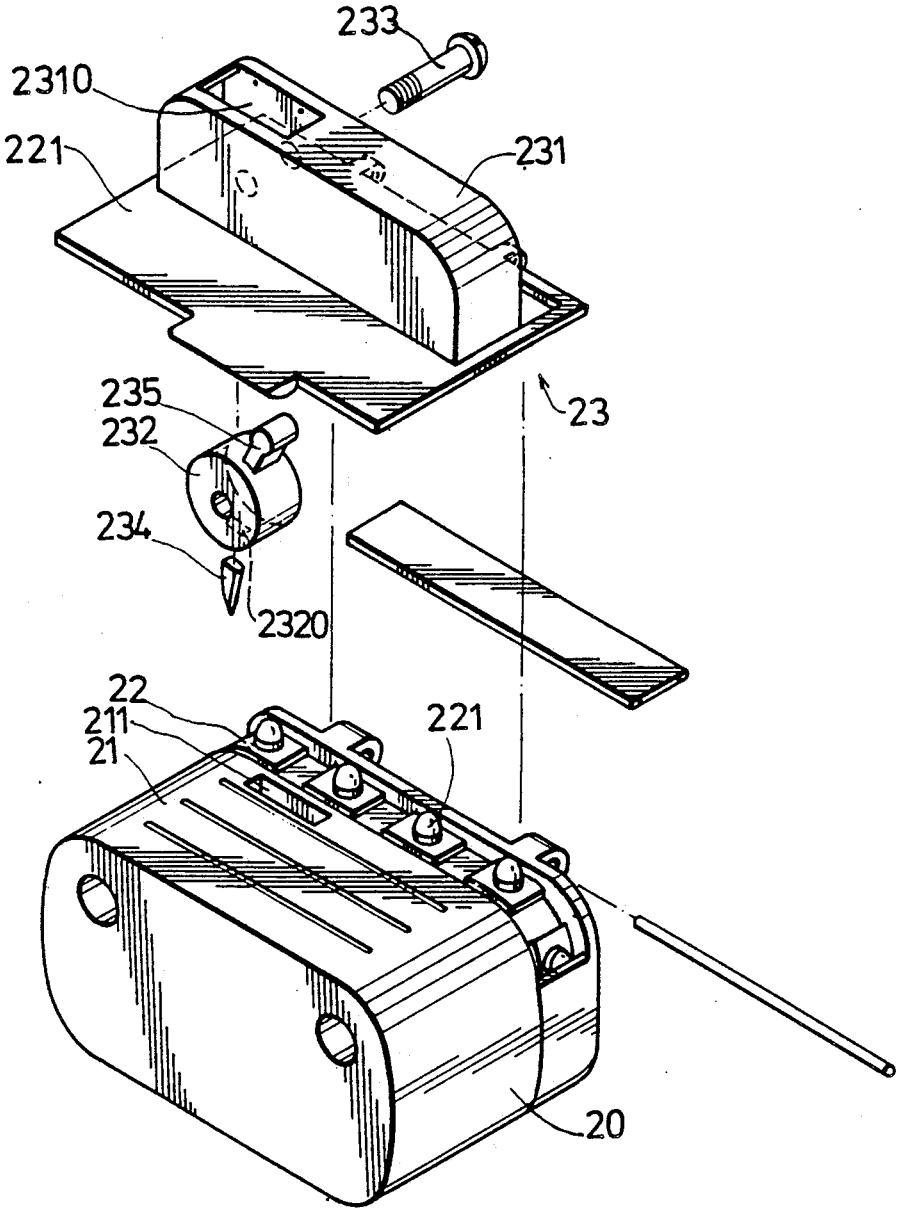
FIG. 2 is a partially exploded view of an improved paper feed device equipped with a paper cutting device of this invention.

FIGS. 2 and 3 show a paper feed device (2) for a printer. The paper feed device (2) includes a base (20) with a paper running surface (21), a circulating belt (22) having a plurality of teeth (221) provided on the outer surface thereof, and a paper feed cover (23) mounted pivotally on the base (20) in a known manner.

A paper cutting device of this invention is incorporated in the paper feed device (2) and includes a casing (231) fixed on the paper feed cover (23), a cylinder (232) mounted rotatably within the casing (231) by a pivot pin (233), and a slot (211) formed in the paper running surface (21) in alignment with the weakened line (31) defining the paper feed strip (32) of a computer form paper (3).

A radially extending cutting blade (234) is inserted tightly into and retained within the cavity (2320) in the circumferential surface of the cylinder (232). A radially extending push lever (235) is secured to the circumferential surface of the cylinder (232) and forms an angle of about 150 degrees with the cutting blade (232).

Figure 4:
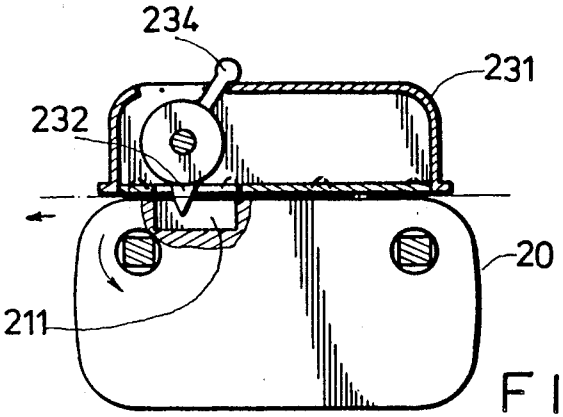
FIG. 4 is a schematic view illustrating the operative position of the cutting blade of the paper cutting device according to this invention.

Referring to FIG. 4, because the push lever (235) extends out of the opening (2310) of the casing (231), the user can actuate the push lever (235) to rotate the cutting blade (234) into the slot (211) of the paper running surface (21) so as to cut the paper feed strip (32) from the remaining portion (33) of the computer form paper (3). The operative position of the cutting blade (232) is between two positions aligned with an adjacent pair of upper teeth (221) so as to effectively force the computer form paper (3) to be cut by the cutting blade (234).

Figure 5:
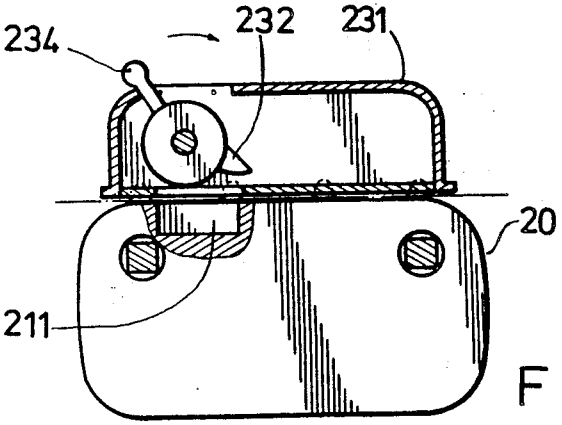
FIG. 5 is a schematic view illustrating the idle position of the cutting blade of the paper cutting device according to this invention.

Referring to FIG. 5, when the printer is idle, the actuation of the push lever (235) can rotate the cutting blade (234) into the casing (231).

Figure 6:
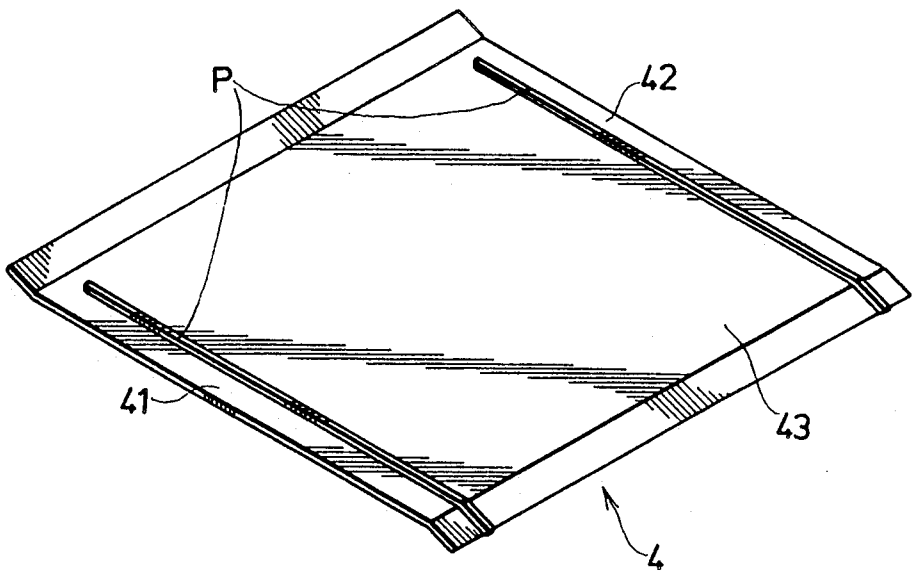
FIG. 6 is a perspective view of a guide plate associated with the paper cutting device of this invention.

FIG. 6 shows a guide plate (4) which may be disposed behind the paper feed devices (2) of the printer. The guide plate (4) includes two elongated projecting ribs (P) provided on the upper surface thereof in alignment with the cutting blades (232) of the paper feed devices (2). The projecting ribs (P) define on the guide plate (4) three guideways (41, 42, 43) for guiding the paper feed strips (32) and the intermediate portion (33) of the computer form paper (3).

With this invention thus explained, it is apparent that numerous modifications and variations can be made without departing from the scope and spirit of this invention. It is therefore intended that this invention be limited only as indicated in the appended claims.

I claim:

1. A printer including a tractor unit which consists of two paper feed devices disposed on two sides of said printer, said tractor unit being capable of advancing a computer form paper on said printer, which has two weakened lines forming two paper feed strips at two sides of said paper, each of said strips having a row of paper feed holes formed therein, each of said paper feed devices including a base with a paper running surface, an endless circulating belt mounted circulatingly on said base and having a plurality of equidistant teeth provided on an outer surface of said circulating belt, a paper feed cover having a pivot side connected pivotally to said base, said circulating belt having an inner side adjacent to said paper running surface, and an outer side adjacent to said pivot side of said paper feed cover, said paper feed cover extending over said paper running surface and said circulating belt so as to engage with upper ends of some of said teeth, each of said paper feed devices being equipped with a paper cutting device, each of said paper cutting devices including a slot formed in said paper running surface in alignment with said weakened line of said computer form paper, and a cutting blade mounted on said paper feed cover and extending into said slot of said paper running surface, characterized in that each of said paper feed covers includes a casing fixed thereon, a cylinder mounted within said casing and rotatable about a horizontal axis, a cavity formed in a circumferential surface of said cylinder, and an actuatable push lever secured to said cylinder, said cutting blades being inserted tightly into said cavity of said cylinder, said cutting blade being capable of being moved into said slot of said paper running surface or said casing of said paper feed cover by rotating said push lever, whereby, when said computer form paper is carried by said circulating belts to pass over said paper running surfaces, said cutting blades cut said paper feed strips from remaining portions of said computer form paper.

* * * * *